US010998110B2

(12) United States Patent
Yu

(10) Patent No.: US 10,998,110 B2
(45) Date of Patent: May 4, 2021

(54) FLAME RESISTANT COVERED CONDUCTOR CABLE

(71) Applicant: Priority Wire & Cable, Inc., Little Rock, AR (US)

(72) Inventor: Bang Wei Yu, Chesapeake, VA (US)

(73) Assignee: Priority Wire & Cable, Inc., Little Rock, AR (US)

( * ) Notice: Subject to any disclaimer, the term of this patent is extended or adjusted under 35 U.S.C. 154(b) by 0 days.

(21) Appl. No.: 16/578,544

(22) Filed: Sep. 23, 2019

(65) Prior Publication Data

US 2020/0234851 A1 Jul. 23, 2020

Related U.S. Application Data

(60) Provisional application No. 62/890,230, filed on Aug. 22, 2019, provisional application No. 62/828,847, filed on Apr. 3, 2019, provisional application No. 62/794,061, filed on Jan. 18, 2019.

(51) Int. Cl.
*H01B 7/295* (2006.01)
*H01B 13/06* (2006.01)

(52) U.S. Cl.
CPC ..... *H01B 7/295* (2013.01); *H01B 13/06* (2013.01)

(58) Field of Classification Search
None
See application file for complete search history.

(56) References Cited

U.S. PATENT DOCUMENTS 2,277,177 A * 3/1942 Wermine ..... H01B 7/0063 174/121 R
2,754,352 A * 7/1956 Connell ..... H01B 9/027 174/107
3,102,160 A * 8/1963 Cook ..... H01B 7/361 174/105 R
3,233,036 A * 2/1966 Jachimowicz ..... H01B 7/2825 174/107
3,304,214 A * 2/1967 Alm ..... B29C 48/15 156/54
3,397,046 A * 8/1968 Greyson ..... H01B 7/2806 428/623
3,433,891 A * 3/1969 MacKenzie, Jr. ..... H01B 3/441 174/120 R
3,643,008 A * 2/1972 Brazee ..... H01B 9/028 174/107

(Continued)

FOREIGN PATENT DOCUMENTS

WO WO-9602920 A1 * 2/1996 ..... H01B 7/295

OTHER PUBLICATIONS

UL Standard for Safety for Wire and Cable Test Methods, UL 2556; Fourth Edition, Dated Dec. 15, 2015; pp. 1-248.

*Primary Examiner* — Timothy J Thompson
*Assistant Examiner* — Krystal Robinson
(74) *Attorney, Agent, or Firm* — Bracewell LLP; Christopher L. Drymalla

(57) ABSTRACT

Provided are embodiments of a flame resistant covered conductor cable, including a conductor wire, a conductor shield disposed about the conductor wire, an inner insulation disposed about the conductor shield, and a flame resistant outer jacket formed of a flame resistant cross-linked polyethylene (FR-XLPE) disposed about the inner insulation.

11 Claims, 1 Drawing Sheet

(56) References Cited

U.S. PATENT DOCUMENTS 3,703,605 A * 11/1972 Dembiak ..... H01B 9/022 174/107
3,823,255 A * 7/1974 La Gase ..... H01B 7/295 174/113 R
3,935,375 A * 1/1976 Ichiba ..... B32B 15/08 174/102 R
4,049,904 A * 9/1977 Hori ..... B32B 15/08 174/107
4,109,098 A * 8/1978 Olsson ..... H01B 9/027 174/106 SC
4,234,624 A * 11/1980 Linderoth ..... B29C 48/06 427/521
4,353,817 A * 10/1982 Nakae ..... C08L 23/06 524/232
4,451,536 A * 5/1984 Barlow ..... H01B 1/24 428/383
4,454,379 A * 6/1984 Cleveland ..... H01B 7/2825 174/107
4,549,041 A * 10/1985 Shingo ..... C08K 3/22 174/113 R
4,577,925 A * 3/1986 Winter ..... G02B 6/4488 228/148
5,302,735 A * 4/1994 Neri ..... C08G 77/26 556/419
5,492,760 A * 2/1996 Sarma ..... C08L 43/04 428/378
6,207,277 B1 * 3/2001 Shieh ..... H01B 7/282 428/375
6,274,066 B1 * 8/2001 Easter ..... H01B 1/24 174/102 SC
6,362,418 B1 * 3/2002 Grandy ..... B60R 16/0207 174/120 R
6,403,887 B1 * 6/2002 Kebabjian ..... H01B 11/002 174/110 R
6,414,059 B1 * 7/2002 Kobayashi ..... C08L 23/04 523/212
6,943,300 B2 * 9/2005 Ekeberg ..... H01B 7/045 174/113 C
7,208,682 B2 * 4/2007 Kuchta ..... H01B 3/446 174/110 R
9,099,225 B2 * 8/2015 Pagliuca ..... H01B 3/441
9,997,278 B2 * 6/2018 Verhoeven ..... H01B 13/227
10,128,026 B2 * 11/2018 Na ..... H01B 1/02
10,199,143 B2 * 2/2019 Ko ..... H01B 9/0688
10,210,967 B2 * 2/2019 Lee ..... C09J 7/243
10,217,547 B1 * 2/2019 Kaneda ..... H01B 7/225
10,325,694 B2 * 6/2019 Sica ..... H01B 7/0009
2002/0077393 A1 * 6/2002 Gugumus ..... C08K 5/005 524/99
2003/0059183 A1 * 3/2003 Militaru ..... G02B 6/441 385/112
2005/0023029 A1 * 2/2005 Mammeri ..... B32B 27/08 174/121 A
2006/0137894 A1 * 6/2006 Cusson ..... H01B 7/20 174/105 R
2006/0151477 A1 * 7/2006 Sundal ..... H05B 3/56 219/549
2014/0166339 A1 * 6/2014 Bates ..... H01B 7/295 174/120 R
2015/0060106 A1 * 3/2015 Polasky ..... B32B 27/08 174/110 S
2016/0329129 A1 * 11/2016 Osborne, Jr. ..... H01B 7/295
2018/0075944 A1 * 3/2018 Iwasaki ..... H01B 3/423

* cited by examiner

FLAME RESISTANT COVERED CONDUCTOR CABLE

RELATED APPLICATIONS

This application claims the benefit of U.S. Provisional Patent Application No. 62/794,061, filed on Jan. 18, 2019 and titled "Flame Resistant Spacer Cable," claims the benefit of U.S. Provisional Patent Application No. 62/828,847 filed on Apr. 3, 2019 and titled "Flame Resistant Covered Conductor Cable," and claims the benefit of U.S. Provisional Patent Application No. 62/890,230 filed on Aug. 22, 2019 and titled "Flame Resistant Covered Conductor Cable," which are hereby incorporated by reference.

FIELD

Embodiments relate generally to electrical cables and more particularly to flame resistant electrical cables.

BACKGROUND

Electrical cables are employed in a variety of context to transfer electrical power or signals. An electrical cable typically includes one or more conductor wires arranged to carry electric current along the cable. The conductor wires are usually formed of solid or stranded wire formed of an electrically conductive material, such as aluminum or copper. Stranded wire may include smaller individual wires twisted or braided together to produce larger wires, and is often more flexible than solid wires of similar size.

Electrical cables used for electric power transmission and distribution (often referred to as "electrical transmission lines," "transmission lines," "overhead power lines" or "power lines") typically include bare conductor wires that are suspended between support structures, such as towers or poles. These types of electrical cables are typically formed of stranded wire formed of aluminum or copper. Aluminum conductors are used in many instances for aluminum's relatively low cost and lightweight in comparison to similarly conductive copper conductors. Copper conductors are also used in some instances in view of copper's relatively high electric conductivity in comparison to similarly sized aluminum conductors. Examples of common conductors used in electrical transmission lines include aluminum conductor steel reinforced (ACSR), all aluminum conductor (AAC) and all-aluminum-alloy conductor (AAAC).

In some instances, electrical transmission lines include insulation (often referred to as an "insulated" line) or coverings (often referred to as a "tree wire", "covered line wire" or a "spacer cable"). Insulated lines include insulation around the conductor. This may enable the electrical transmission line to be directly connected to a supporting structure without the use of insulating supports between the line and the structure. Covered lines include a cover around the conductor that inhibits direct contact with the conductor. For example, some electrical transmission lines include a thermoplastic or cross-linked polyethylene covering around the conductor that forms an exterior of the transmission line. Although the covering may not provide insulation that is sufficient to forgo the use of insulating supports between the line and a supporting structure, the covering may inhibit direct contact with wildlife and tree limbs, or other things that may come into brief contact with the line. Covered lines are most often used in heavily wooded areas where tree-line contact is likely.

SUMMARY

Although traditional electrical cables used for electric power transmission and distribution (often referred to as "electrical transmission lines," "transmission lines," "overhead power lines" or "power lines") can be suitable for use in certain conditions, they may not be suitable for use in relatively harsh conditions. For example, in windy conditions the bare conductors of electrical transmission cables may be blown into contact with adjacent conductors, which can result in breaking or melting of the conductors and the dripping of molten metal on to the ground below, which can spark fires. Accordingly, traditional transmission lines may not be suitable for use in windy and fire prone areas. Although covered lines have been employed in some instances in an effort to reduce the risks associated with electrical transmission cables installed in windy and fire prone areas, these types of lines can suffer from shortcomings that create additional risks. For example, the covering material (such as a thermoplastic or a cross-linked polyethylene) may not be flame resistant and, thus, may be susceptible to burning which can propagate flames and fires. When a flame is introduced to this type of covered cable, such as during a wildfire, the covering material may burn, thereby enabling the fire to propagate horizontally along the line and resulting in flaming and melted particles of the covering material falling to the ground, which can causing other (or "secondary") fires in the area under and around the length of the line. Thus, a covered cable may enhance the spread of an original fire. This can be especially concerning in areas that are prone to fires, such as wooded and rural areas.

Recognizing these and other shortcomings of electrical cables, provided are novel flame resistant (FR) covered conductor cables and associated methods. In some embodiments, a FR covered conductor cable is constructed of a conductor and a flame resistant outer covering. For example, a FR covered conductor cable may include the following a conductor, a conductor shield disposed about the conductor, an inner insulation (e.g., formed of cross-linked polyethylene (XLPE)) disposed about the conductor shield, and an outer FR insulation (or "jacket") (e.g., formed of a flame resistant cross-linked polyethylene (FR-XLPE)) disposed about the inner insulation. In some embodiments, a FR covered conductor cable is formed by way of an extrusion that includes simultaneously extruding the three layers surrounding the conductor. For example, for the conductor shield material, the XLPE and the FR-XLPE may be simultaneously extruded through a triple head extrusion fixture to form the conductor shield, the inner insulation and the outer FR insulation about the conductor. In some embodiments, nitrogen is employed during the extrusion process as heating and pressure crosslinking agent. This may enhance bonding between the conductor and the layers, which can provide thermal stability under a variance of temperature that can inhibit burning and propagation of flames along the cable.

Figure 1A:
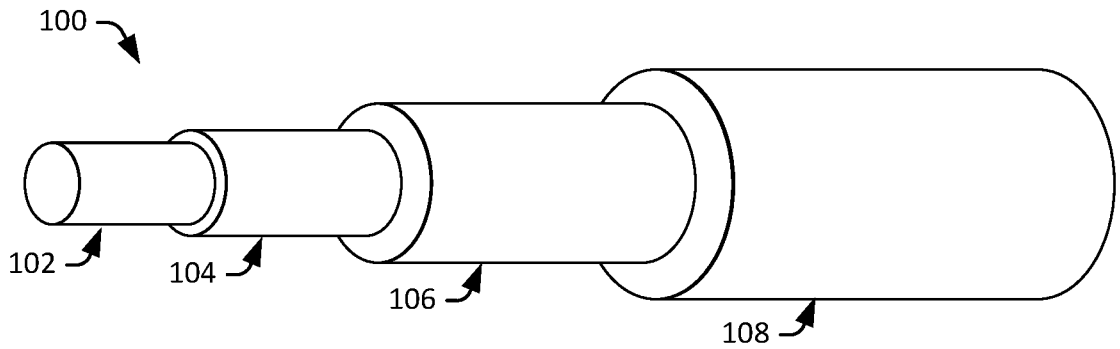
FIGS. 1A and 1B are diagrams that illustrate a flame resistant (FR) covered conductor cable in accordance with one or more embodiments.

While this disclosure is susceptible to various modifications and alternative forms, specific embodiments are shown by way of example in the drawings and will be described in detail. The drawings may not be to scale. It should be understood that the drawings and the detailed descriptions are not intended to limit the disclosure to the particular form disclosed, but are intended to disclose modifications, equivalents, and alternatives falling within the spirit and scope of the present disclosure as defined by the claims.

DETAILED DESCRIPTION

Described are embodiments of flame resistant (FR) covered conductor cables and associated methods. In some embodiments, a FR covered conductor cable is constructed of a conductor and a flame resistant outer covering. For example, a FR covered conductor cable may include the following a conductor, a conductor shield disposed about the conductor, an inner insulation (e.g., formed of cross-linked polyethylene (XLPE)) disposed about the conductor shield, and an outer FR insulation (or "jacket") (e.g., formed of a flame resistant cross-linked polyethylene (FR-XLPE)) disposed about the inner insulation. In some embodiments, a FR covered conductor cable is formed by way of an extrusion that includes simultaneously extruding the three layers surrounding the conductor. For example, for the conductor shield material, the XLPE and the FR-XLPE may be simultaneously extruded through a triple head extrusion fixture to form the conductor shield, the inner insulation and the outer FR insulation about the conductor. In some embodiments, nitrogen is employed during the extrusion process as heating and pressure crosslinking agent. This may enhance bonding between the conductor and the layers, which can provide thermal stability under a variance of temperature that inhibits burning and propagation of flames along the cable.

Figure 1B:
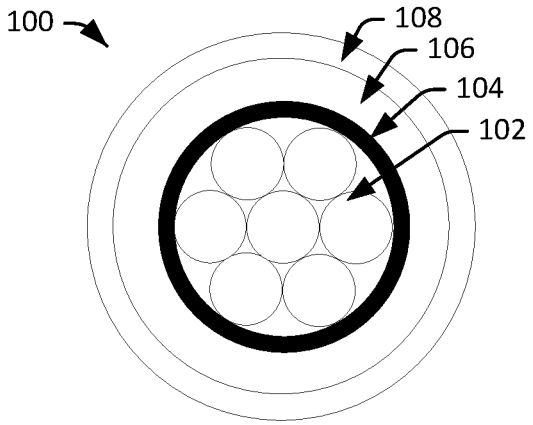

FIGS. 1A and 1B are diagrams that illustrate cut-away and end/cross-sectioned views, respectively, of a FR covered conductor cable ("FR cable") 100 in accordance with one or more embodiments. Such an FR cable 100 maybe particularly well suited for use as an electrical cable for electric power transmission and distribution (often referred to as an "electrical transmission line," "transmission line," "overhead power line" or "power line"). The electrical cable 100 may be referred to as "flame resistant covered transmission line" in the context of electric power transmission and distribution applications.

In the illustrated embodiment, the FR cable 100 includes the following: (1) a conductor wire 102; (2) a conductor shield 104 disposed about the conductor wire 102; (3) an inner insulation 106 disposed about the conductor shield 104; and (4) a flame resistant (FR) outer insulation (or "outer jacket") 108 disposed about the inner insulation 106. As described, in some embodiments, the inner insulation 106 is formed of a layer of cross-linked polyethylene (XLPE) and the FR outer insulation (or "FR outer jacket") 108 is formed of a layer of flame resistant cross-linked polyethylene (FR-XLPE). The FR-XLPE may be resistant to burning and dripping, which can inhibit burning and propagation of flames along the FR cable 100.

The conductor wire 102 may provide a path for the transmission of electrical signals (e.g., electrical power or control signals) across the FR cable 100. In some embodiments, the conductor wire 102 includes a solid or stranded conductor wire formed of an electrically conductive material, such as copper, copper plated with a thin layer of another metal (such as tin, gold or silver) or aluminum. For example, the conductor wire 102 may be an aluminum conductor steel reinforced (ACSR) wire, an all-aluminum conductor (AAC) wire, an all-aluminum-alloy conductor (AAAC) wire, or a copper wire. The conductor wire 102 may be of a suitable size to transfer electrical signals (e.g., electrical power and/or control signals) across the FR cable 100. For example, the conductor wire 102 may be of a size 2 American Wire Gauge (AWG) to 2000 thousand circular mils (kcmil or MCM).

The conductor shield 104 may be a layer of an intermediate substrate that separates the conductor wire 102 and inner insulation 106, or facilitates bonding of the inner insulation 106 about the conductor wire 102. In some embodiments, the conductor shield 104 is formed of a layer of semi-conducting polymer. For example, the conductor shield 104 may be formed of a layer of semi-conducting mylar tape. For example, the layer of semi-conducting mylar tape may be applied over the conductor, with a layer of semi-conducting polymer (e.g., Borlink LE0595-07 available from Borealis of Port Murray, N.J., U.S.A.) extruded over the mylar tape to form a conductor stress relief shielding. In some embodiments, the conductor shield 104 has a radial thickness of about 10 thousandths of an inch (mils) to 25 mils of thickness. In some embodiments, the material forming the conductor shield 104 is extruded about the circumference of the conductor wire 102.

The inner insulation 106 may be a layer of an intermediate substrate that electrically or thermally insulates the conductor wire 102 and the conductor shield 104 from surrounding elements (e.g., from the FR outer insulation 108) and the environment surrounding the FR cable 100. In some embodiments, the inner insulation 106 is formed of a polyethylene material. For example, the inner insulation 106 may be formed of cross-linked polyethylene (XLPE). In some embodiments, the inner insulation 106 has a radial thickness of about 75 mils to 225 mils. In some embodiments, the material forming the inner insulation 106 is extruded about the circumference of the conductor shield 104.

The FR outer insulation (or "FR outer jacket") 108 may be a layer of a flame resistant (FR) jacketing substrate that physically protects and electrically or thermally insulates the conductor wire 102, the conductor shield 104 and the inner insulation 106 from the environment surrounding the FR cable 100. In some embodiments, the FR outer insulation 108 includes a flame resistant material that inhibits a flame from propagating for more than one minute. That is, the FR outer insulation 108 is "flame resistant" in that any flame that does develop in the FR outer insulation material 108 will self-extinguish in about one minute or less. The FR cable 100 may be fire-rated (e.g., "FV" or "FT" rated) based on its flame resistance. The FR outer insulation 108 may also not melt or drip within at least a first minute of any flame propagation. For example, if a flame does develop and self-extinguish within about one minute, the FR outer insulation 108 may not drip from (or otherwise fall from) the FR cable 100 as a result of the flame. In some embodiments, the FR outer insulation 108 includes fire retardants additives that reduce the flammability of the FR outer insulation 108 by blocking a flame from developing physically or by initiating a chemical reaction that extinguishes the flame. For example, the FR outer insulation 108 may include an additive that, when heated, release water or carbon dioxide to dilute radicals that extinguish a flame. As described, in some embodiments, the FR outer insulation 108 includes aluminum hydroxide that dehydrates to form aluminum oxide (alumina, $Al_2O_3$) and release water vapor.

In some embodiments, the outer insulation 108 is formed of a flame resistant (FR) polyethylene material. For example, the FR outer insulation 108 may be formed of flame resistant cross-linked polyethylene (FR-XLPE). In some embodiments, the FR outer insulation (or "FR outer jacket") 108 has a radial thickness of about 75 mils to 200 mils. In some embodiments, the material forming the FR outer insulation 108 is extruded about the circumference of the inner insulation 106.

XLPE may be a low- to high-density polyethylene (e.g., polyethylene having low density in the range of 0.910-0.925 g/cm$^3$ or a density of greater than 0.941 g/cm$^3$) containing cross-link bonds introduced into the polymer structure, changing the thermoplastic into a thermoset. For example, the XLPE may have a density of about 0.922 g/cm$^3$, a melting point of about 265-284° C., a tensile strength of about 2480 pounds per square inch (psi), an elongation 450%, and 75% cross-linking.

In some embodiments, the FR-XLPE material is composed of PE and additives such as a cross-linking agent and additives that inhibit burning and dripping of the material. For example, the FR-XLPE material may include the following:

Base material:

Polyethylene (PE) $(C_2H_4)_n$

Additives:

a Dicumyl peroxide (DCP) ($C_{18}H_{22}O_2$);

an antioxidant (e.g., Antioxidant 300 ($C_{22}H_{30}O_2S$)+Antioxidant 1076 ($C_{35}H_{62}O_3$));

a flame retardant agent (e.g., aluminum hydroxide ($Al(OH)_3$)+magnesium hydroxide ($Mg(OH)_2$)); and UV stabilizer (e.g., UV Stabilizer HS-770 ($C_{28}H_{50}O_4N_2$)+Chimassorb 944 ($C_{35}H_{69}Cl_3N_8$)).

In some embodiments, the FR-XLPE material includes 40-60% by weight (wt %) XLPE and the additives (e.g., 1.5-3.0% DCP, 0.8-1.5% antioxidant, 35-55% FR agent and 0.5-1.5% UV stabilizer).

Dicumyl Peroxide (DCP) may also be used as a cross-linking agent. For example, PE may interact with the DCP crosslinker to form the XLPE.

Antioxidants may be compounds that inhibit oxidation. The antioxidant additives may be a polymer stabilizer that inhibits the degradation of the PE that may cause a loss of strength and flexibility of the FR-XLPE of the FR outer insulation 108. In some embodiments, the antioxidant may be a multi-functional sulfur containing hindered phenolic antioxidant. In some embodiments, the antioxidant may have an oxygen update induction period of 35.2 minutes at 200° C. at a dosage of 0.1% in polyetheylene. In some embodiments, the antioxidant is Antioxidant 300 $C_{22}H_{30}O_2S$ 4.4' -Thiobis(6-tert-butyl-m-cresol) available from China BlueStar Guangzhou Research Institute of Synthetic Materials of Guangzhou, China. Antioxidant 1076 $C_{35}H_{62}O_3$ Octadecyl 3-(3,5-di-tert-butyl-4-hydroxyphenyl) propionate may be a nonpolluting type nontoxic antioxidant. In some embodiments, the antioxidant is Antioxidant 1076 available from Disheng Technology Co., Ltd of Zhejiang, China.

The flame retardant agent may include compounds added to the PE to slow or prevent the start or growth of a fire in the FR-XLPE of the FR outer insulation 108. For example, when heated, the aluminum hydroxide in the flame retardant agent may dehydrate to form aluminum oxide (alumina, $Al_2O_3$), releasing water vapor in the process, as shown in Equation (1).

$$2AL(OH)_3+Heat=AL_2O_3+3H_2O \quad (1)$$

This reaction may absorb a great deal of heat, cooling the FR outer insulation 108 material into which it is incorporated. Additionally, the residue of alumina may form a protective layer on the FR outer insulation 108 material's surface. Similarly, when heated, the magnesium hydroxide in the flame retardant agent may dehydrate to form magnesium oxide and also release water vapor, as shown in Equation (2):

$$Mg(OH)_2+Heat=MgO+H_2O \quad (2)$$

The UV Stabilizer may include compounds added to the PE to absorb UV radiation and dissipate the associated energy as low-level heat to prevent UV degradation of the FR-XLPE of the FR outer insulation 108. For example, UV Stabilizer HS-770 $C_{28}H_{52}O_4N_2$, Bis(2,2,6,6-tetramethyl-4piperidyl) sebacate may be a radical scavenger that protects organic polymers against degradation caused by exposure to ultraviolet radiation. UV Stabilizer HS-770 may be that available from BASF SE of Ludwigshafen, Germany. In another example, Chimassorb 944 $(C_{35}H_{68}N_8)_n$, Poly[[6-[(1,1,3,3 -tetramethylbutyl)amino]-s-triazine-2,4-diyl]-[(2,2,6,6-tetramethyl-4-piperidyl)imino]-hexamethylene-[(2,2,6,6-tetramethyl-4-piperidyl)imino]] may be an oligomeric hindered amine light stabilizer (HALS). Chimassorb 944 may be that available from BASF SE of Ludwigshafen, Germany.

Figure 2:
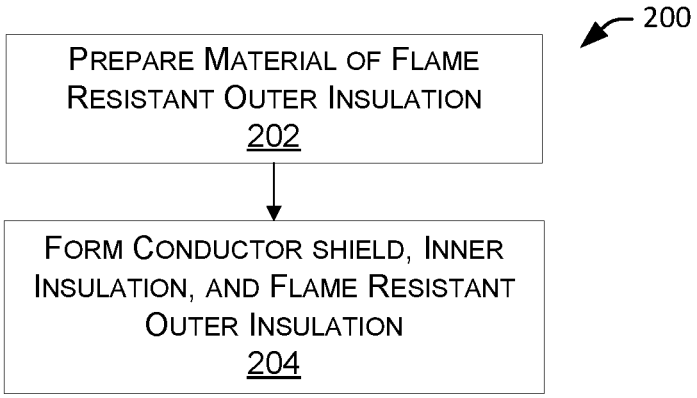
FIG. 2 is a flowchart diagram that illustrates a method of manufacturing a FR covered conductor cable in accordance with one or more embodiments.

FIG. 2 is a flowchart diagram that illustrates a method 200 of manufacturing a FR covered conductor cable 100 in accordance with one or more embodiments. In some embodiments, method 200 includes preparing the material of the FR outer insulation (block 202). This may include, for example, preparing the FR-XLPE, including combining of the base material (e.g., PE) and additives (e.g., including the DCPs, the antioxidants, the flame retardant agent, and the UV stabilizer).

In some embodiments, method 200 includes forming the conductor shield, the inner insulation, and the FR outer insulation (or "FR outer jacket") about the conductor wire (block 204). This may include disposing the conductor shield 104 about the conductor wire 102, disposing the inner insulation 106 about the conductor shield 104, and disposing the FR outer insulation (or "FR outer jacket") 108 about the inner insulation 106 to form the FR covered conductor cable 100. In some embodiments, forming the conductor shield, the inner insulation, and the FR outer insulation (or "FR outer jacket") about the conductor wire includes simultaneously extruding the three layers surrounding the conductor wire 102. For example, for the conductor shield material (e.g., semi-conducting polymer, such as mylar tape having a semi-conducting polymer extruded over the mylar tape), the inner insulation material (e.g., XLPE), and the FR outer insulation (or "FR outer jacket") material (e.g., FR-XLPE) may be simultaneously extruded through a triple head extrusion fixture to form the conductor shield 104, the inner insulation 106 and the FR outer insulation (or "FR outer jacket") 108 about the conductor wire 102. In some embodiments, nitrogen is employed during the extrusion process as a heating and pressure crosslinking agent. The extrusion process may include a vulcanizing process that utilize the nitrogen gas as a treatment agent which provides a higher temperature and pressure (e.g., nitrogen having a temperature of at or about 450° C. and pressures less than or equal to 20 bars), and that promotes complete bonding between the insulation and FR insulation material. The higher temperature and pressure can increase the material tensile strength, hardness, abrasion resistance and tear strength. This may enhance bonding between the layers, which can provide thermal stability under a variance of temperature that can inhibit burning and propagation of flames along the cable.

In some embodiments, the method 200 may be performed by a control system. For example, some or all of the operations of method 200 may be controlled by a computer system executing program instructions stored on a non-transitory computer readable storage medium that, when executed, cause the operations of method 200.

Embodiments of the FR covered conductor cable 100 described may eliminate the spread of fires along transmission lines, which can reduce secondary fires caused by the propagation and dripping of flaming material. Further, the FR covered conductor cable 100 may allow utilities to restore power to communities impacted by fire much faster since the amount of line replacement needed is greatly decreased.

Embodiments of the FR covered conductor cable 100 may meet the challenge of maintaining 100% bonding to the substrate material and the needed physical and dielectric properties. For example, such bonding may provide additional dielectric strength, increase the covering material physical strength, prevent contamination between the two layers (e.g., between the FR outer insulation 108 and the inner insulation 106), eliminate air gaps and reduce the overall diameter of the FR covered conductor cable 100. In some instances, the additives in the FR outer insulation 108 may reduce the dielectric strength to 75% of the original XLPE property. Accordingly, promoting bonding (e.g., 100% bonding between the FR outer insulation 108 and the inner insulation 106) can help to improve the performance of the FR covered conductor cable 100.

The flame resistance of the FR covered conductor cable 100 may be defined by meeting or exceeding the requirements of UL 2556 for the FT1 ("Vertical Flame Test") and FT2 "FH" or "Horizontal Flame Test") flame tests. The following provides a summary of these tests:

FT1/Vertical Flame Test: the finished conductor is considered Flame Resistant if: It does not convey flame. It does not continue to burn for more than 60 s after five 15 s applications of flame in the standard vertical flame test. (i.e. Self-extinguishing). The extended portion of the indicator is not burned more than 25 percent. The procedure/parameters of the FT1 test method are outlined in UL 2556.

FT2/FH/Horizontal Flame Test: the finished conductor is considered Flame Resistant if: It does not convey flame along its length or to any combustible materials in its vicinity during test. The total length of char on the specimen shall not exceed 100 mm (4 in.). The dripping particles emitted by the specimen during or after application of flame shall not ignite the cotton in the test enclosure. The procedure/parameters of the FT2 test method are outlined in UL 2556.

Testing of FR covered conductor cables manufactured in accordance with the describe embodiments has demonstrated an ability to inhibit flame propagation and inhibit dripping of melted material from the cable. For example, a FR covered conductor cable was secured vertically and a burner was used to apply the flame while secured at an angle of 20° to the vertical cable (pursuant to UL standard 2556). In a first test (Test 1—FT1/VW1) a FR covered conductor cable (secured as described) was subject to five cycles of flame application for 15 seconds (with a break of 15 seconds there between), which resulted in the cable not burning during or after the flame applications (and flaming material did not drip/fall from the cable). In a second test (Test 2—exceeding FT1 a FR covered conductor cable (secured as described) was subject to five cycles of flame application for 30 seconds (with a break of 15 seconds there between), which resulted in the cable not propagating the flame, and self-extinguished (e.g., the cable did exhibit flaming/burning for longer than 38 seconds) (and flaming material did not drip/fall from the cable). For example, a FR covered conductor cable was secured horizontally and a burner was used to apply the flame while secured at an angle of 20° from the vertical position (pursuant to UL standard 2556). In the test (Test 3—FT2/FH/Horizontal Flame) a FR covered conductor cable (secured as described) was subject to flame application for 30 seconds, which resulted in the cable not burning during or after the flame applications (and flaming material did not drip/fall from the cable).

Although certain embodiments are described for the purpose of illustration, the techniques can be employed for other embodiments. For example, although certain embodiment are described with regard to transmission lines, embodiments may be employed in other context, such as other types of electrical cables.

Further modifications and alternative embodiments of various aspects of the disclosure will be apparent to those skilled in the art in view of this description. Accordingly, this description is to be construed as illustrative only and is for the purpose of teaching those skilled in the art the general manner of carrying out the embodiments. It is to be understood that the forms of the embodiments shown and described here are to be taken as examples of embodiments. Elements and materials may be substituted for those illustrated and described here, parts and processes may be reversed or omitted, and certain features of the embodiments may be utilized independently, all as would be apparent to one skilled in the art after having the benefit of this description of the embodiments. Changes may be made in the elements described here without departing from the spirit and scope of the embodiments as described in the following claims. Headings used here are for organizational purposes only and are not meant to be used to limit the scope of the description.

As used throughout this application, the word "may" is used in a permissive sense (such as, meaning having the potential to), rather than the mandatory sense (such as, meaning must). The words "include," "including," and "includes" mean including, but not limited to. As used throughout this application, the singular forms "a", "an," and "the" include plural referents unless the content clearly indicates otherwise. Thus, for example, reference to "an element" may include a combination of two or more elements. As used throughout this application, the term "or" is used in an inclusive sense, unless indicated otherwise. That is, a description of an element including A, B or C may refer to the element including A, B, C, A and B, A and C, B and C, or A, B and C.

What is claimed is:

1. A method of forming a flame resistant covered conductor cable, comprising: extruding a conductor shield material about a conductor wire to form a conductor shield; extruding a cross-linked polyethylene (XLPE) material about the conductor shield to form an inner insulation; and extruding a flame resistant cross-linked polyethylene (FR-XLPE) about the inner insulation to form a flame resistant outermost jacket, wherein the conductor shield material, the XLPE material and the FR-XLPE material are simultaneously extruded to form the conductor shield, the inner insulation and the flame resistant outermost jacket.

2. The method of claim 1, wherein the flame resistant cross-linked polyethylene (FR-XLPE) material comprises cross-linked polyethylene (PE) and a flame retardant agent additive.

3. The cable of claim 2, wherein the flame retardant agent additive is configured to release water or carbon dioxide when heated.

4. The method of claim 2, wherein the flame retardant agent additive comprises aluminum hydroxide ($Al(OH)_3$) and magnesium hydroxide ($Mg(OH)_2$)) compound.

5. The method of claim 1, wherein the flame resistant cross-linked polyethylene (FR-XLPE) material consists of cross-linked polyethylene (PE), a Dicumyl peroxide (DCP) additive, an antioxidant additive, a flame retardant agent additive, and a UV stabilizer additive.

6. The method of claim 1, wherein the flame resistant cross-linked polyethylene (FR-XLPE) material comprises cross-linked polyethylene (PE), a Dicumyl peroxide (DCP) additive, an antioxidant additive, a flame retardant agent additive, and a UV stabilizer additive.

7. The method of claim 6, wherein the flame retardant agent additive comprises an aluminum hydroxide ($Al(OH)_3$) and magnesium hydroxide ($Mg(OH)_2$)) compound.

8. The method of claim 1, wherein the simultaneous extrusion of the conductor shield material, the XLPE material and the FR-XLPE material comprises a simultaneous triple head extrusion of the conductor shield material, the XLPE material and the FR-XLPE material about the conductor wire.

9. The method of claim 1, wherein the simultaneous extrusion comprises employing nitrogen as a heating and pressure crosslinking agent.

10. The method of claim 1, wherein the conductor wire comprises an aluminum conductor steel reinforced (ACSR) wire, an all-aluminum conductor (AAC) wire, an all-aluminum-alloy conductor (AAAC) wire, or a copper wire.

11. The method of claim 1, wherein the conductor shield comprises a layer of semi-conductive tape and the extrusion of the conductor shield material comprises extruding a layer of semi-conductive polymer over the semi-conductive tape.

* * * * *